US005143144A

United States Patent [19]

Laloi et al.

[11] Patent Number: 5,143,144

[45] Date of Patent: Sep. 1, 1992

[54] REAR SPACER OF A MOULD FOR PRESSURE CASTING FLAT METAL PRODUCTS SUCH AS SLABS

[75] Inventors: Maurice R. Laloi, Planfoy; Michel F. Courbier, Le Breuil; Robert R. Vatant, Saint-Chamond, all of France

[73] Assignees: Creusot-Loire Industrie, Puteaux; Clecim, Cergy Pontoise, both of France

[21] Appl. No.: 721,577

[22] PCT Filed: Jan. 12, 1990

[86] PCT No.: PCT/FR90/00025

§ 371 Date: Sep. 10, 1991

§ 102(e) Date: Sep. 10, 1991

[87] PCT Pub. No.: WO90/07999

PCT Pub. Date: Jul. 26, 1990

[30] Foreign Application Priority Data

Jan. 16, 1989 [FR] France ..... 89 00456

[51] Int. Cl.[5] ..... B22D 18/04

[52] U.S. Cl. ..... 164/306; 164/339; 164/342; 164/348; 249/80; 249/134; 249/161

[58] Field of Search ..... 164/348, 306, 309, 339, 164/342, 119, 137

[56] References Cited

U.S. PATENT DOCUMENTS

| | | | |
|---|---|---|---|
| 3,434,528 | 3/1969 | McGeeney | 164/339 |
| 3,590,904 | 7/1971 | Woodburn, Jr. | 164/348 X |
| 3,604,497 | 9/1971 | Sylvester | 164/137 X |
| 4,669,524 | 6/1987 | Nelson | 164/128 X |
| 4,733,714 | 3/1988 | Smith | 164/306 X |

FOREIGN PATENT DOCUMENTS 1558163 10/1969 Fed. Rep. of Germany .

OTHER PUBLICATIONS

Abstract of Japanese Patent Publication 61-182865 Published Aug. 15, 1986.

Abstract of Japanese Patent Publication 62-173063 Published Jul. 29, 1987.

*Primary Examiner*—J. Reed Batten, Jr.

*Attorney, Agent, or Firm*—Cushman, Darby & Cushman

[57] ABSTRACT

The spacer comprises a body made from a single piece of metal of hollow form having a U-shaped transverse section. The concave part of this section faces towards the rear and the front face of the hollow body correspondiung to the base of the U forms the moulding wall of the spacer. A bent metal inner sleeve provides a free space of small thickness which has a U-shaped cross-section in which circulating water cools the moulding wall over its entire length. The space also comprises lateral parts in contact with the lateral walls of the hollow body.

14 Claims, 3 Drawing Sheets

REAR SPACER OF A MOULD FOR PRESSURE CASTING FLAT METAL PRODUCTS SUCH AS SLABS

The invention relates to a rear spacer of a mould for pressure casting flat metal products of great thickness, such as slabs.

A casting method which consist in introducing a ladle containing the metal to be cast inside a vessel which is then closed by a cover applied in a leaktight manner to the upper edge of the vessel has been known and used for a long time. The cover of the vessel carries a tube in refractory material the lower part of which is immersed in the metal filling the ladle and the upper part of which communicates with an opening which passes through the cover of the vessel equipped with means for connecting to a spout for casting the metal in the mould.

The assembly consisting of the vessel containing the ladle and equipped with its closing cover can be brought into a casting position beneath a mould comprising a filling spout at its lower part. The spout for filling the mould is caused to coincide and to come into leaktight contact with the device for connecting the cover of the ladle, then compresses air is conveyed inside the vessel so as to cause the metal to rise inside the refractory tube, then inside the mould, until the latter is completely filled.

By regulating the pressure of the gas conveyed in the ladle, the conditions for casting the metal and filling the mould are perfectly controlled, which makes it possible to obtain castings of a very satisfactory and uniform quality.

This pressure-casting method can be applied to the production of flat steel products of great thickness, such as slabs.

The moulds used for the pressure casting of slabs comprise a support and tilting frame mounted so as to pivot about a horizontal axis so that it may be inclined very slightly, relative to the horizontal plane, in order to connect the spout for filling the mould to the exit opening of the cover of the vessel before commencing the casting operation.

The mould principally comprises two lateral walls of large dimensions disposed parallel and opposite one another, the inner faces which are lined with graphite blocks of which form the surfaces of the mould which come into contact with the molten metal in order to delimit the two large faces of the slab.

The lateral walls are mounted on the frame so as to be movable in the direction perpendicular to their moulding faces, that is to say in the transverse direction of the mould corresponding to the thickness of the moulded product. The closing of the other faces of the cavity of the mould, of substantially parallelepipedal form, is provided by spacers inserted between the two lateral walls which are clamped against these spacers during casting and cooling of the metal introduced into the mould.

The width of the spacers in the transverse direction determines the thickness of the flat product being cast.

One of these spacers, called the rear spacer, closed the casting cavity of parallelepipedal form according to a direction corresponding to the width of the slab, on the side of the mould opposite to its front end via which the molten metal penetrates into the casting cavity. This spacer is disposed in a substantially vertical direction and can be displaced in the longitudinal direction of the mould corresponding to the longitudinal direction of the slab by a device carried by the rear part of the support and tilting frame. This rear spacer makes it possible to regulate the length of the casting cavity and thus the length of the slab being moulded.

During casting, the molten metal which is introduced into the casting cavity via the lower end of tis front part comes into contact, firstly, with the lower spacer and then reached the rear spacer whose lower end is at a slightly higher level than the level at which the molten metal is introduced, the frame being slightly titled forwards in the casting position. The molten metal then rises progressively inside the casting cavity, the rear spacer being in contact with a layer of molten metal whose height progressively increased.

The part of the rear spacer forming the moulding wall of the face of the rear end of the slab, which comes into direct contact with the molten metal, is thus subjected to stresses and to a thermal cycle which are much more unfavourable than for the lower spacer, which is placed in thermal equilibrium with the molten metal over its entire length from the start of casting and than for the upper spacer which comes into contact with the molten metal only at the end of casting.

It has thus been proposed to produce the casting wall of the rear spacer of the mould in a stainless steel, in particular, and to cool this wall on its face opposite the moulding cavity by a circulation of water.

In a known embodiment of the prior art, the rear spacer of the casting mould consist of a block of carbon steel with a substantially square or rectangular cross-section, the length of which corresponds substantially to the total length of the rear spacer and which is machined on one of its faces to form a channel for the circulation of cooling water. The moulding wall is stainless steel is attached to the face of the block made from carbon steel so as to close the cooling channel in a totally leaktight manner on the side of the casting cavity of the slab.

The cooling channel may also be machined in the thickness of the wall made from stainless steel which is attached against a plane face of the carbon steel block forming the structures of the spacer.

In all cases, the stainless-steel plate is welded onto the carbon steel block, over its entire periphery, in the area close to the hottest part of the spacer during casting, undergoing the greatest thermal stresses.

The cooling water is circulated over a substantial part of the length of the moulding wall and in contact with its rear face opposite the cast metal by virtue of channels for feeding and recovering water passing through the carbon steel block forming the rear part of the spacer. The cooling water generally circulates upwards, according to the length of the spacer.

In order to absorb the longitudinal expansions during casting of the metal, the carbon steel block forming the rear part of the spacer can comprise successive transverse slots delimiting parts of the spacer which can expand independently of one another, to a certain extent.

Despite the efficiency of the cooling of the moulding wall made from stainless steel, such an embodiment of the rear spacer of the mould has a drawback which can be extremely serious, originating from the fact that, during the repeated thermal cycles undergone by the spacer upon successive casts, cracks appear through the weld joining the stainless-steel wall and the carbon steel block. The cooling water is then capable of passing through these cracks and pouring out into the casting cavity of the mould. Explosions may then arise which are extremely dangerous for the operators running the casting installation and which risk producing considerable damage to the mechanisms of the mould.

The invention thus aims to propose a rear spacer of a mould for pressure casting flat metal products of great thickness, such as slabs, which closes the mould in the direction of the width of the slab, on the side opposite to the entry of the molten metal into the mould, connected to a device for displacement in the longitudinal direction of the mould carried by the rear part of the frame, so as to have, towards the inside of the cavity of the mould, a metal moulding wall cooled by a circulation of water, this spacer making it possible to prevent any risk of the introduction of water into the cavity of the mould during the cast.

To this end, the rear spacer according to the invention comprises

- a body made from a single piece of metal of hollow form having a U-shaped transverse section, the concave part of which faces towards the rear and the front face of which corresponding to the base of the U forms the moulding wall which comes into contact with the cast metal,
- an metal inner sleeve which is bent so as to have a substantially U-shaped transverse section, disposed inside the hollow body over a substantial part of its length so that a free space of small thickness, the transverse section of which is in the form of a U, is made between the hollow body and the inner sleeve, the end of the walls corresponding to the branches of the U of which is welded to the inside of the hollow body over their entire length in areas which are distant from the moulding wall,
- and two devices for feeding and recovering cooling water, respectively, disposed in the longitudinal end parts of the hollow body in communication with the free space at its ends in order to establish a circulation of cooling water in the free space in contact with the inner surface of the hollow body.

In order to make the invention clearly understood, a description will now be given by way of non-limiting example of a mould for pressure casting slabs and, more particularly, of a rear spacer of this mould according to the invention.

FIG. 1 shows the assembly of a mould for pressure casting slabs denoted generally by the reference numeral 1.

Figure 1:
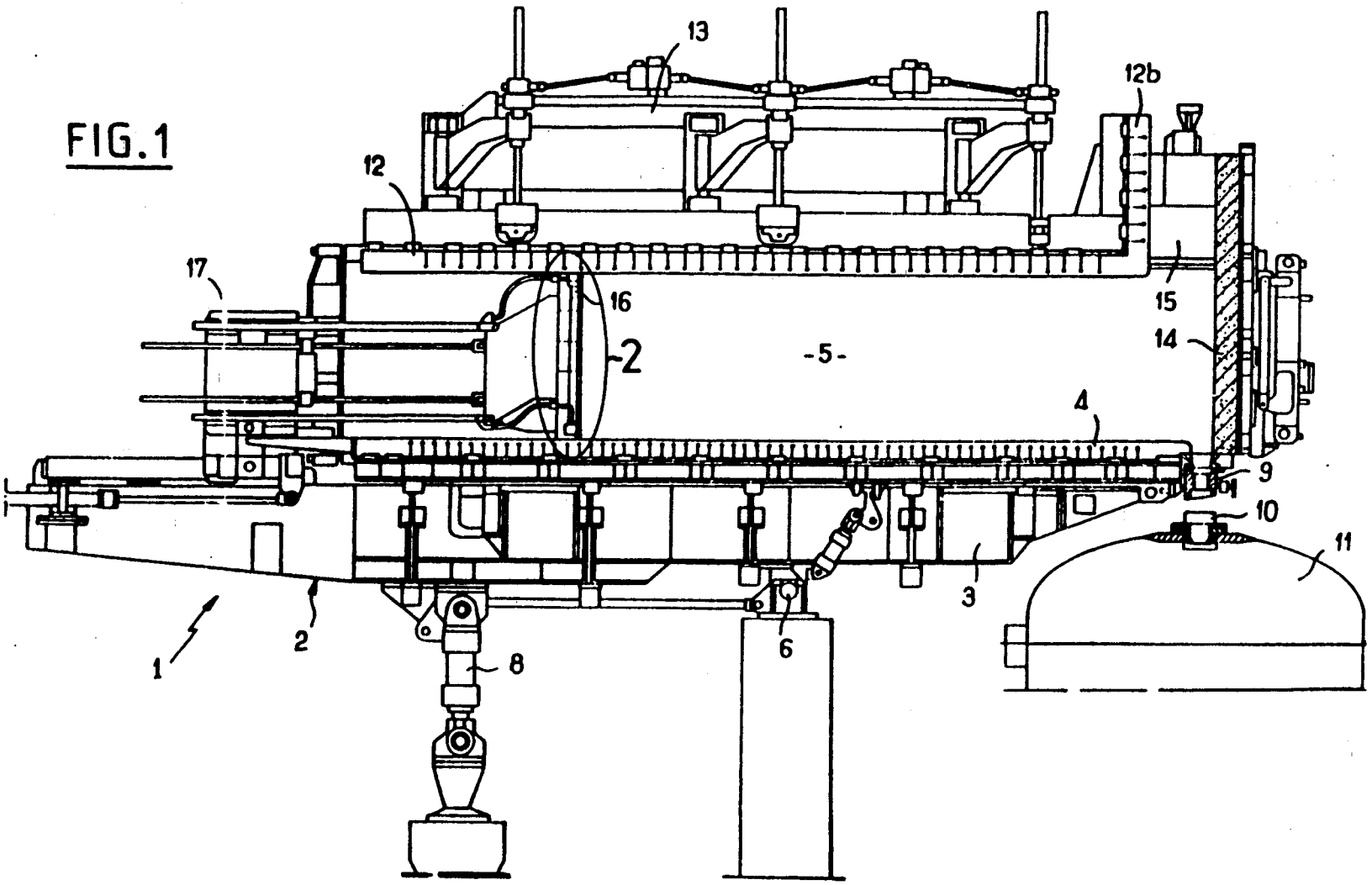
FIG. 1 is a sectional view through a vertical plane of the assembly of a mould permitting the pressure casting of slabs.

This mould comprises a lower structure 2 consisting of a frame 3 and a lower spacer 4 fixed on the upper part of the frame 3.

The frame 3 forms an element for supporting and tilting the walls delimiting the moulding cavity 5 of the slab.

Moreover, the frame 3 is mounted so as to tilt about a horizontal shaft 6 located in the vicinity of the central part of the mould in the longitudinal direction corresponding to the longitudinal direction of the slab.

The mould 1 comprises a casting and filling spout 9 placed at one of the ends of the lower spacer 4 and of the frame 3, forming the front end of the mould.

A jack 8 makes it possible to tilt the mould 1 between a horizontal position in which the spout 9 is slightly above a connection device 10 fixed to the top of the cover 11 of the vessel of the pressure-casting installation and a position in which the mould is tilted forwards by a few degrees, the end of the casting and filling spout 9 then coming into leaktight contact with the connection means 10 fixed on the cover 11 of the vessel of the pressure-casting installation.

In this tilted position, the filling spout 9 is in communication with a spout fixed on the cover 11 of the vessel and immersed in a ladle of steel. By conveying air at a controlled pressure inside the vessel closed by the cover 11, the steel is caused to rise in the tube so that it progressively fills the cavity 5 of the mould passing through the filling spout 9.

In addition to the lower spacer 4 fixed on the frame 3, the casting mould 1 comprises an upper spacer 12 fixed to a suspension assembly 13 and held in a position which is substantially parallel to the lower spacer 4. The upper spacer 12 comprises an end front part **12*b* which is substantially vertical in the operating position of the spacer 12**.

A front spacer 14 made from graphite is disposed vertically at the front of the mould so that its lower part delimits, with the front part of the lower spacer 4, a passage of a certain width in communication with the spout 9 for casting and filling the mould with the molten metal.

The upper part of the front spacer 14 delimits a riser 15 with the vertical front part **12*b* of the upper spacer 12. The riser 15 connects the moulding cavity 5** with a header in which the metal shrinks at the end of casting.

The mould 1 also comprises a rear spacer 16 which can be displaced in the longitudinal direction of virtue of a device 17 fixed on the rear part of the support and tilting frame 3. The rear spacer 16 which is the subject of the invention will be described in greater detail with reference to FIGS. 2 and 3.

The lateral walls are mounted so as to be movable in the transverse direction, that is to say in a direction perpendicular to the plane of FIG. 1, on the frame 3, so as to come into leaktight contact against the lateral faces of the spacers 4, 12, 14 and 16 in order to close the moulding cavity 5.

The lateral walls consist of graphite blocks which are juxtaposed and held in supports so as to from the inner moulding wall of the cavity 5 according to the large faces of the slab parallel to the plane of FIG. 1.

IF it is desired to modify the thickness of the moulding cavity 5 in the transverse direction, in order to change the thickness of the slab, it is necessary to change all the spacers whose thickness in the transverse direction determines the thickness of the casting cavity 5 and of the slab.

Figure 2:
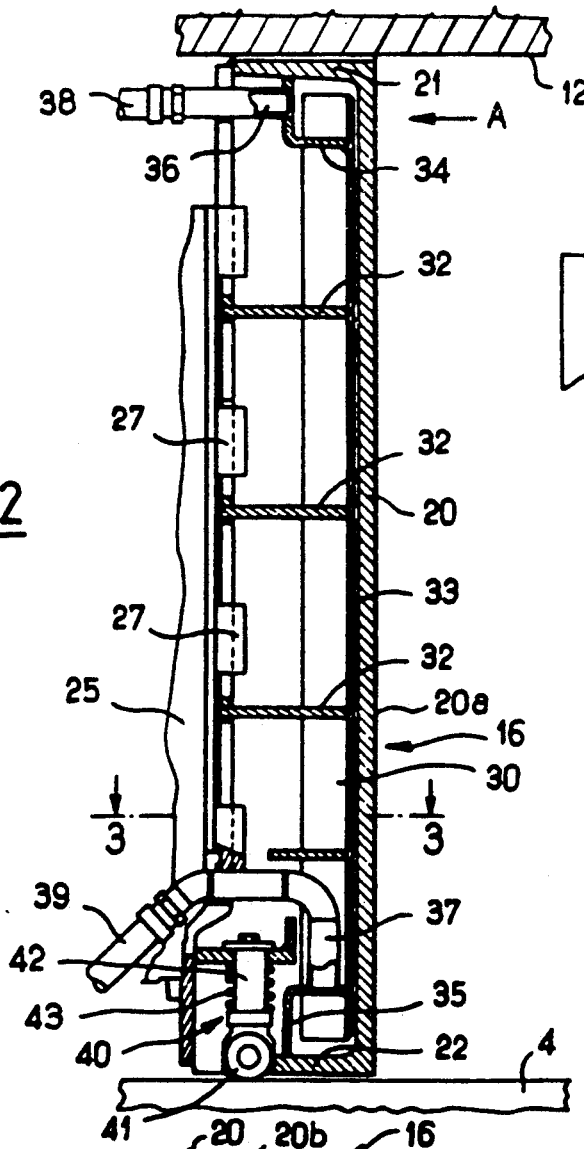
FIG. 2 is a view in longitudinal section of the rear spacer of the mould shown in FIG. 1, corresponding to the detail 2 in FIG. 1.
Figure 3:
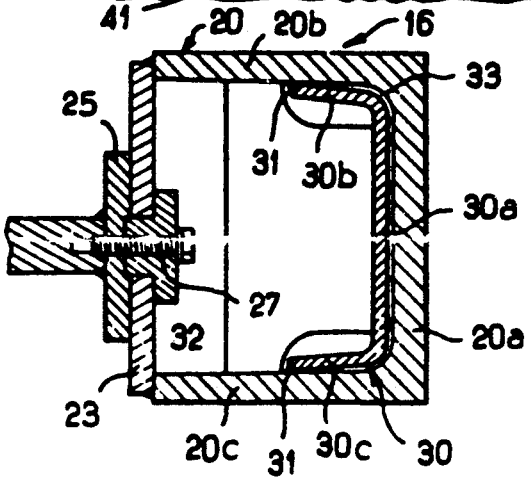
FIG. 3 is a sectional view according to 3—3 in FIG. 2.

FIGS. 2 and 3 show in greater detail the structure of the rear spacer 16 which is the subject of the invention.

The spacer 16 consists principally of a hollow body 20 made from stainless steel or refractory, whose outer dimension, according to the length of the spacer corresponds to the width of the casting cavity 5 of the mould 1, that is to say the width of the slab.

As may be seen in FIG. 3, the hollow body 20 has, in transverse, the form of a U whose base 20*a* forms the moulding wall of the spacer which comes into contact with the molten metal via its outer surface and whose branches 20*b* and 20*c*, substantially perpendicular to the moulding wall 20*a*, form the lateral walls of the spacer. In the clamping position of the mould, the lateral walls in graphite which mould the large faces of the slab come into contact with the outer surface of the lateral walls 20*b* and 20*c* of the 16, the distance between these outer surfaces determining the thickness of the slab.

The hollow body 20 also comprises upper and lower longitudinal end walls 21 and 22, respectively, substantially perpendicular to the moulding wall 20*a*.

The distance between the outer surfaces of the longitudinal end walls 21 and 22, at the ends of the moulding wall 20*a*, corresponds to the width of the casting cavity 5, that is to say to the width of the slab cast, the spacer 16 being in contact, via its ends 21 and 22, with the upper spacer 12 and with the lower spacer 4, respectively.

The hollow body 20 thus has a substantially parallelepipedal inner cavity which is totally open on one side opposite the moulding wall 20*a*.

The hollow body 20, produced in a single piece, may advantageously be obtained by moulding a stainless steel or refractory of an appropriate grade in a mould of corresponding form.

The lateral walls 20*b* and 20*c* and the longitudinal end walls 21 and 22 are connected on the inside to the moulding wall 20*a* via the rounded surfaces in the form of portions of a cylinder improving the mechanical characteristics and, in particular, the resistance to cracking of the hollow body 20.

On the end parts of the lateral walls 20*b* and 20*c* opposite to the moulding wall 20*a* is fixed a closing plate 23 of the hollow body 20 by means of which the spacer 16 is connected to a structure 25 which provides the join between the rear spacer 16 and its displacement device 17 and comprises guiding bars 24 and thrust and traction bars 26, which can be seen in FIG. 1.

The structure 25 is connected tot he closing plate 23 by means of screwed joining devices 27.

The spacer 16 also comprises, inside the hollow body 20 and over a substantial part of its height, an inner sleeve 30 consisting of a stainless-steel sheet which is bent so as to have a transverse section in the form of a U, as may be seen in FIG. 3.

The inner sleeve 30 is fixed to the inside of the hollow body 20 by means of the outer end of its lateral walls 30*b* and 30*c*, which correspond to the branches of the U which are fixed, by welding over their entire length, to the inner surface of the lateral walls 20*b* and 20*c*, respectively, of the hollow body 20, in zones of these walls which are distance from the moulding wall 20*a*.

In the embodiment shown in FIGS. 2 and 3, the weld beads 31 connecting the inner sleeve 30 to the hollow body 20 in a leaktight manner, according to the longitudinal direction of this hollow body, are disposed in a zone located substantially in the centre of the corresponding branches 20*b* and 20*c*.

A free space 33, whose U-shaped cross-section can be seen in FIG. 3, is provided between the inner sleeve 30 and a part of the inner surface of the hollow body 20 formed by the assembly of the inner surface of the moulding wall 20*a* and the front part of the inner surface of the lateral walls 20*b* and 20*c*.

Transverse holding spacers 32, fixed on the closing plate 23 of the hollow body 20, are distributed according to the length of the spacer 16 and bear via their end part opposite the plate 23 on the bottom of the inner sleeve 30 at the level of its part 30*a* corresponding to the base of the U.

The fixing welds of the inner sleeve and the spacers ensure the inner sleeve is held such that it can be deformed by expansion, within a certain range, while ensuring its correct positioning inside the hollow body 20 so as to conserve the form and the dimensions of the free space 33 between the inner sleeve 30 and the inner wall of the hollow body in a substantially constant manner, in the vicinity of the moulding wall 20*a*.

As may be seen in FIG. 2, the inner sleeve 30 comprises longitudinal ends providing a certain free space relative to the inner surface of the longitudinal closing walls 21 and 22 of the hollow body 20.

Two walls 34 and 35, consisting of a stainless-steel sheet which is bent and shaped, are welded in the vicinity of the ends of the inner sleeve 30, on this inner sleeve and according to its entire inner periphery which corresponds to the inside of the U shown in FIG. 3.

In addition to this first part fixed by welding to the inside of the U-shaped cross-section of the sleeve 30, the walls 34 and 35 comprise a second part folded substantially at 90° relative to the first part of the corresponding wall and welded along its edges, on the one hand in the longitudinal direction, on the inner surface of the lateral walls 20*b* and 20*c* of the hollow body 20, and, on the other hand, according to the transverse direction, on the corresponding end wall 21 or 22.

A pipe 36 passes through the wall 34 to which it is fixed in a leaktight manner. In the same manner, a pipe 37 passes through the wall 35 to which it is fixed in a leaktight manner. The ends of the pipes 36 and 37 opposite the walls 34 and 35 are connected to hoses 38 and 39, respectively.

The walls 34 and 35 delimit entirely leaktight water boxes at the ends of the hollow body 20 which make it possible to establish a circulation of cooling water in the space 33 provided between the sleeve 30 and the inner surface of the hollow body 20.

The hose 39 is connected to the lower guiding bar 24 of the rear spacer 16 inside which is provided a channel which permits the passage of a tube for feeding water to the hose 39 and to the water box delimited by the wall 35.

In the same manner, the hose 38 is connected to the upper guiding bar 24 of the spacer 16. This upper guiding bar comprises a channel for recovering the cooling water which has circulated downwards in the space 33, the upper part of which communicates with the water box 34.

During casting, it si thus possible to ensure cooling of the moulding wall 20*a* of the spacer 16 regardless of the position of this spacer in the mould.

As the width of the U-shaped space 33 is very small (a few millimeters), it is possible to ensure very rapid circulation of the cooling water in the space 33 with a moderate rate of feed. Very efficient cooling is thus ensured, while avoiding any vaporization of water inside the cooling channel.

The bending and the method of fixing the inner sleeve 30 make it possible to absorb, by deformation of this sleeve, differences in expansion between the moulding wall and the inner lateral walls of the spacer. This conserves the good elasticity of the assembly and the welds of the sleeve and the water boxes on the hollow body are not stressed beyond permissible limits, that is to say in a manner which would risk giving rise to a tearing away of or damage to these welds.

Moreover, the welds of the inner sleeve 30 and of the walls 34 and 35 on the hollow body 20 are located in zones which are distant from the moulding wall 20*a* which comes into contact with the molten metal and forms the hot zone of the spacer which is subjected to high thermal stresses.

The joining welds between the walls 34 and 35 of the water boxes and the inner sleeve 30 are cooled efficiently by the circulation of water.

The welding are thus subjected to moderate thermal stresses and mechanical stresses such that the risks of cracking and of loss of leaktightness of the cooling channel and of the water hoses are considerably reduced.

Moreover, if a well should nevertheless crack, the corresponding leakage of water would take place towards the outside of the mould and not towards the inside, which eliminates the risks of explosion due to the water coming into contact with the molten metal cast in the mould.

When the assembly of the spacer is produced in stainless steel, this spacer is unlikely to corrode in the air or the atmospheric humidity during its storage between two use campaigns or, alternatively, during its use in the mould.

The rear spacer according to the invention can thus be stored without particular precautions and reused without there being a risk of pollution or blocking of the inner or outer cooling circuits. The moulding wall can thus be cooled in every case in an optimum manner and without a risk of leakage of water towards the inside of the mould.

As may be seen in FIG. 2, the closing wall 23 of the hollow body 20 towards the outside of the mould spacer, comprising a travelling roller 41 on the upper surface of the lower spacer 4, this roller being mounted in a telescopic manner on a holding rod 42 by means of a spring 43. This device 40 makes it possible to displace the rear spacer 16 on the lower spacer 4 in order to regulate the length of the mould. The mould is closed by the front part of the longitudinal end wall 22 of the body 20 of the spacer, which as a slight forward inclination relative tot he lower spacer.

Figure 2A:
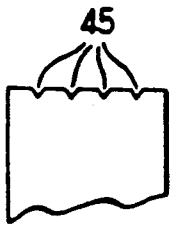
FIG. 2A is a partial view according to A in FIG. 2.

The upper longitudinal closing wall 21 comprises a series of longitudinal channels 45 of small dimensions, which may be seen in FIG. 2A, permitting the discharge of the air remaining in the mould at the end of the cast, during filling of the upper part of the mould and of the riser 15.

The channels may have a grater depth in their rear part than in their front part facing the inside of the mould. This prevents the channels being blocked in their rear part and enhances the discharge of the air while preventing the passage of the steel via the shallow front part of the channels.

The channels may be of reduced length and located only in the front part of the spacer; the rear part of the spacer may then have an opening for the air to escape which is very side and in which the channels emerge. This escape opening may have a depth which increases towards the rear of the spacer, the channels communicating with the front part of the escape opening having a depth which is sufficiently shallow to prevent the passage of the steel.

Figure 4:
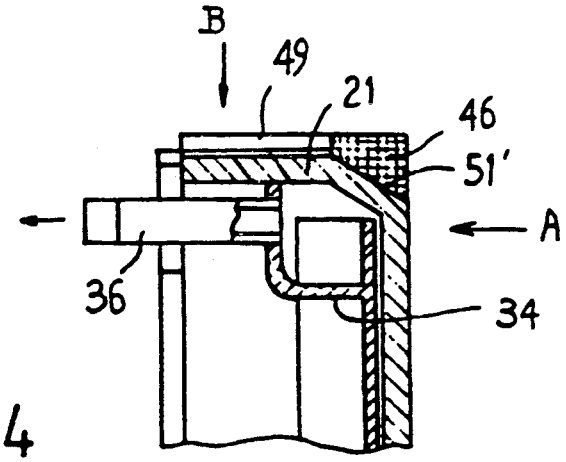
FIG. 4 is a view in longitudinal section of the upper part of a spacer according to the invention and according to an laternative embodiment.
Figure 4A:
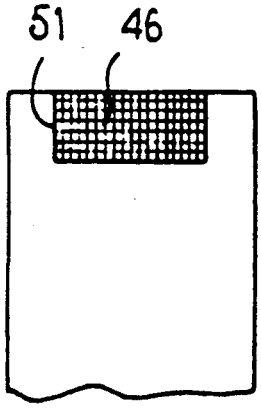
FIG. 4A is a front view according to A in FIG. 4.
Figure 4B:
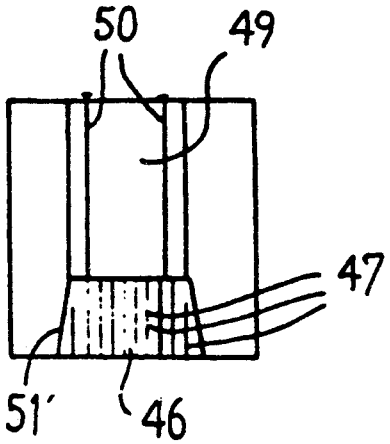
FIG. 4B is a plan view according to B in FIG. 4.

FIGS. 4, 4A and 4B show an alternative embodiment of the upper part of the spacer, the corresponding elements in FIG. 2 on the one hand and in FIGS. 4, 4A and 4B on the other hand bearing the same reference numerals.

In this embodiment, the upper longitudinal closing wall 21 of the spacer ha, in its front part, a cavity 51 having relief parts 51', in which is housed a metal-wire grid 46 of suitable form.

As may be seen in FIG. 4B, the grid 46 provides channels 47 for the passage of the air remaining in the corner of the mould at the end of the cast. When the molten metal enters into contact with the grid 46, it solidifies and the grid becomes attached to the slab. The grid is thus a consumable element which can be replaces at each casting cycle. The grid trapped by the solidified slab follows the shrinkage of the latter during its cooling, the reliefs 51' being provided in order to release the upper corner of the slab during its contraction.

The passage 49 of great width located at the rear of the cavity 51 of the spacer forms a channel which permits good ventilation of the inner cavity 5 of the mould. The assembly of the grid 46 and of the channel 49 thus ensures ready discharge of the air/gas mixture so that the pressurization of the gaseous mixture and the turbulences of the molten steel bath which is produced if the vent is unblocked violently through the action of pressure are avoided.

The grid is held in place by hooks 50 fixed to the rear of the spacer and made in the form of light elements which do not interfere with the shrinkage of the slab.

By using such a grid vent, defects in the slab, such as cracks on its rear face and laps due to uncontrolled movements of the steel during the reestablishment of the levels between the header and the rear part of the slab, are prevented.

Finally, the dimensions of the channel 49 are such that, fi the grid 46 should fall or be forgotten, the steel solidifies in the channel and is not deposited on the rear part of the mould.

The invention is not limited to the embodiment which has been described.

Thus, it is possible to imagine using a hollow body made from stainless steel whose form is slightly different from that which has been described. Similarly, the form of the inner sleeve limiting the cooling channel may be different.

In all cases, the cooling channel 33 must comprise parts which are turned outwards along the lateral walls of the hollow body.

This hollow body may be made from a stainless steel or refractory of any grade or any non-ferrous ally or metal with suitable properties and using a method other than a moulding method provided that this hollow body is produced in a single piece without join welding between the various parts of its wall.

The invention applies in all cases where a rear face of a mould for the pressure casting of slabs is closed by a metal spacer.

We claim:

1. A rear spacer of a mould for pressure casting a flat metal products of great thickness which serves as a movable mould boundary in a direction of the width of the flat metal product, on the side opposite to where molten metal enters the mould, the spacer is connected to a device for displacing the spacer in the longitudinal direction of the mould so as to have, towards the inside of the cavity of the mould, a movable metal moulding wall which is cooled by circulating water, comprising:

a hollow body made from a single piece of stainless steel of hollow form, having a U-shaped transverse section including a concave part which faces towards a rearside of the mould and a convex face which forms the moulding wall which contacts the molten metal;

a metal inner sleeve which is bent so as to have a substantially U-shaped transverse section, disposed inside the hollow body over a substantial part of the length of the hollow body, so that a free space of small thickness, the transverse section of said free space being in the form of a U, is made between the hollow body and the inner sleeve, ends of walls of the inner sleeve, corresponding to branches of the U formed spaced, being welded to the inside of the hollow body over the entire length of the moulding wall; and feeding and recovering means for feeding and recovering cooling water disposed in the longitudinal end parts of the hollow body in communication with the free space at its end for establishing a circulation of cooling water in the free space in contact with the inner surface of the hollow body

2. A spacer according to claim 1, wherein the means for feeding and receiving cooling water comprises two walls of sheet metal fixed by welding to the metal inner sleeve in the vicinity of the ends of the metal inner sleeve in areas which are distant from the moulding wall, so as to form two water boxes connected to pipes for feeding and recovering water and communicating with the ends of the U-shaped free space.

3. A spacer according to claim 1 or 2, wherein the hollow body includes a moulded piece made from stainless steel.

4. A spacer according to claim 3, wherein the inner sleeve includes a sheet made from stainless steel.

5. A spacer according to claim 1 wherein the hollow body comprises a closing wall connected to lateral walls on the side opposite to the moulding wall by means of which the spacer is connected to a structure for connecting the spacer to a displacement device.

6. A spacer according to claim 5, wherein the spacer comprises a plurality of transverse spacers fixed on a closing plate of the hollow body and disposed inside the hollow body in order to hold the inner sleeve while permitting deformations of the inner sleeve through the action of expansion.

7. A spacer according to claim 1, wherein the spacer comprises a wall closing a longitudinal upper end of the hollow body having on its outer surface venting means for the discharge of gases at the upper part of the mould, at the end of a cast.

8. A spacer according to claim 7, wherein the venting means comprises channels of small dimensions joining the cavity of the mould to a rear part of the spacer.

9. A spacer according to claim 7, wherein the venting means comprises a plurality of channels of small dimensions communicating with the cavity of the mould at one of their ends an combining to form a single channel communicating with the rear of the spacer at other ends.

10. A spacer according to claim 9, wherein the single channel has a depth which increases from a first end, in which the channels emerge at the mould to a greater depth at a second end emerging at the rear of the spacer.

11. A spacer according to claim 7, wherein the venting means comprises: a metal grid disposed in a small cavity emerging in the cavity of the mould and made in the wall, of the mould; and a channel also made in the wall, joining the small cavity to a rear part of the spacer.

12. A spacer according to claim 11, wherein the small cavity comprises relief parts.

13. A spacer according to claim 11, wherein the metal grid is connected to the body of the spacer by hooks made in the form of light elements.

14. A spacer according to claim 11, characterized in that the channel has dimensions which ensure that the molten metal is trapped in its inner volume, if the grid does not hold back the molten metal.

* * * * *